US006230799B1

(12) United States Patent
Slaughter et al.

(10) Patent No.: US 6,230,799 B1
(45) Date of Patent: May 15, 2001

(54) ULTRASONIC DOWNHOLE RADIATOR AND METHOD FOR USING SAME

(75) Inventors: Julie C. Slaughter, Ames, IA (US); Michael L. Fraim, Bakersfield, CA (US)

(73) Assignee: Etrema Products, Inc., Ames, IA (US)

( * ) Notice: Subject to any disclaimer, the term of this patent is extended or adjusted under 35 U.S.C. 154(b) by 0 days.

(21) Appl. No.: 09/207,779

(22) Filed: Dec. 9, 1998

(51) Int. Cl.[7] ..... E21B 28/00

(52) U.S. Cl. ..... 166/249; 166/60; 166/66.5; 166/177.2; 340/854.6; 340/854.8

(58) Field of Search ..... 166/249, 66.5, 166/60, 248, 177.2; 340/854.6, 854.8

(56) References Cited

U.S. PATENT DOCUMENTS

| | | | | |
|---|---|---|---|---|
| 3,578,081 | | 5/1971 | Bodine | 166/249 |
| 3,583,677 | | 6/1971 | Phillips | 259/1 |
| 3,718,186 | | 2/1973 | Brandon | 166/248 |
| 3,970,146 | | 7/1976 | Keenan, Jr. | 166/249 |
| 4,164,978 | * | 8/1979 | Scott | 166/249 |
| 4,512,402 | | 4/1985 | Kompanek et al. | 166/249 |
| 4,544,031 | | 10/1985 | Bodine | 166/177 |
| 4,558,737 | * | 12/1985 | Kuznetsov et al. | 166/60 |
| 4,632,215 | | 12/1986 | Farris | 181/114 |
| 4,639,905 | | 1/1987 | Goodloe | 367/189 |
| 4,702,315 | | 10/1987 | Bodine | 166/249 |
| 4,726,741 | | 2/1988 | Cusack | 417/322 |
| 4,788,467 | | 11/1988 | Plambeck | 310/323 |
| 4,795,318 | | 1/1989 | Cusack | 417/322 |
| 4,805,727 | | 2/1989 | Hardee et al. | 181/106 |
| 4,850,449 | | 7/1989 | Cheung | 181/101 |
| 4,874,061 | | 10/1989 | Cole | 181/106 |
| 4,927,334 | | 5/1990 | Engdahl et al. | 417/322 |
| 4,993,001 | | 2/1991 | Winbow et al. | 367/144 |
| 5,083,613 | * | 1/1992 | Gregoli et al. | 166/275 |
| 5,101,899 | | 4/1992 | Hoskins et al. | 166/248 |
| 5,109,698 | * | 5/1992 | Owen | 73/632 |
| 5,109,922 | | 5/1992 | Joseph | 166/65.1 |
| 5,184,037 | | 2/1993 | Kobayashi et al. | 310/26 |
| 5,344,532 | | 9/1994 | Joseph | 204/157.15 |
| 5,361,837 | | 11/1994 | Winbow | 166/249 |
| 5,406,153 | | 4/1995 | Flatau et al. | 310/26 |
| 5,501,425 | | 3/1996 | Reinicke et al. | 251/129.15 |
| 5,520,522 | | 5/1996 | Rathore et al. | 417/322 |
| 5,676,213 | * | 10/1997 | Auzerais et al. | 175/58 |
| 5,984,578 | * | 11/1999 | Hanesian et al. | 405/128 |
| 6,012,521 | * | 1/2000 | Zunkel et al. | 166/249 |

OTHER PUBLICATIONS

Sadeghi et al., "Novel Extraction of Tar Sands by Sonication wih the Aid of in Situ Surfactants," (1990) Energy & Fuels, vol. 4, No. 5, pp. 604–608.

Fairbanks et al., "Mineral Recovery and Water Clarification Aided by Ultrasound," (Aug. 10,1985) Revised, Abstract.

(List continued on next page.)

*Primary Examiner*—David Bagnell
*Assistant Examiner*—Zakiya Walker
(74) *Attorney, Agent, or Firm*—Flehr Hohbach Test Albritton & Test LLP

(57) ABSTRACT

An apparatus for use down a bore hole to reduce the viscosity of a hydrocarbon-containing fluid in the bore hole. The apparatus includes a housing having a size for disposition in the bore hole. At least one ultrasonic transducer is carried by the housing. The ultrasonic transducer preferably has an active element changeable from a first shape to a second shape in the presence of an electromagnetic field. An electromagnetic field is provided through at least a portion of the active element to change the shape of the active element. An acoustic element is coupled to the active element for providing ultrasonic energy to the hydrocarbon-containing fluid in the bore hole. A method for reducing the viscosity of a hydrocarbon-containing fluid in a bore hole is additionally provided.

28 Claims, 3 Drawing Sheets

OTHER PUBLICATIONS

Beresnev et al., "Elastic–wave stimulation of oil production: A review of methods and results," (Jun. 1994), Geophysics, vol. 59, No. 6, pp. 1000–1017.
Haney et al., "Technical Review of the High Energy Gas Stimulation Technique," Norjet Geotechnologies Inc. (Not dated).
Ashchepkov, "Infiltration Characteristics of Inhomogeneous Porous Media In A Seismic Field," (1990), Plenum Publishing Corporation, pp. 492–496.
Gibson, Jr., "Radiation from seismic sources in cased and cemented boreholes," (Apr. 1994), Geophysics, vol. 59, No. 2, pp. 518–533.
Chen et al., "Experimental studies on downhole seismic sources," (Dec. 1990), Geophysics, vol. 55, No. 12, pp. 1645–1651.
Winbow, "Seismic sources in open and cased boreholes," (Jul. 1991), Geophysics, vol. 56, No. 7, pp. 1040–1050.
Ogura et al., "Downhole Seismic Source Based on New Concept," OYO Corporation, pp. 325–341 (Not dated).
Gibson, Jr. et al., "Low– and high–frequency radiation from seismic sources in cased boreholes," (Nov. 1994), Geophysics, vol. 59, No. 11, pp. 1780–1785.
Lee, "Low–frequency radiation from point sources in a fluid–filled borehole," (Sep. 1986), Geophysics, vol. 51, No. 9, pp. 1801–1807.
Sewell et al., "Comparison Of Magnetic Biasing Techniques For Terfenol D," (1990 or earlier) Presented at 2nd Intl. Conference on Giant Magnetostrictive and Amorphous Alloys for Actuators and Sensors.
Design Idea of the Month, "Magnetostrictive materials find use in ultrasonic welding," (May 1991), one page.
Hansen et al., "Ultrasonic Application Using Magnetostrictive Smart Materials," (Nov. 1994), 6 pages.
Crawford, "Eastern Euorpean Advances in Ultrasonics and Acoustics," (Nov. 1995), Presented at the Ultrasonic & Acoustic Transducer Group Meeting, NPL, Teddington, U.K., 16 pages.
Etrema Products, Inc., "Etrema Terfenol–D Magnetostrictive Actuators," (1993 or earlier), 6 pages.
Goodfriend et al., "Characteristics fo the Magnetostrictive Alloy Terfenol–D produced for the manufacture of devices," (1992 or earlier), 10 pages.
Goodfriend et al., "High force, high strain, wide band width linear actuator using the magnetostrictive material, Terfenol–D," (1993 or earlier), 12 pages.
Etrema Products, Inc., "Etrema Terfenol–D Magnetostrictive Actuators," (Dec. 31, 1995 or earlier), 4 pages.
Butler, "Application Manual for the Design of Etrema Terfenol–D Mangetostrictive Transducers," (1988), pp. 1–67.
Hiller et al., "Attenuation And Transformation Of Vibration Through Active Control Of Magnetostrictive Terfenol," Jnl. of Sound and Vibration (1989), vol. 134, No. 3, pp. 507–519.
Miller, "High Force, High Strain, Wide Bandwidth Linear Actuators Using The Magnetostrictive Material Terfenol D," (1991), Proceedings on the Conference on Recent Advances in Active Control of Sound and Vibration, Technomic Publishing Co, Inc. Lancaster, PA, 9 pages.
Harris, "Shock and Vibration Handbook," (1988) 3rd Edition, pp. 25–1 to 25–26, McGraw–Hill, NY, NY.
Edge Technologies, Inc., Etrema Products Division, "Terfenol–D Notes," (Jan. 1991), vol. 4, No. 1, 4 pages.
Edge Technologies, Inc., Etrema Products Division, "Magnetostrictive Actuators," (Published in 1992, estimate) 4 pages.
Buskho et al., "High Performance Magnetostrictive Actuators," (Aug., 1991) IECEC Proceedings, vol. 4, pp. 241–245.
Goodfriend et al., "Application of a Magnetostrictive Alloy, Terfenol–D to Direct Control of Hydraulic Valves," (Sep. 2, 1990) Issue of SAE Transactions.
Suzuki et al., "Magnetostrictive Plunger Pump," (Nov. 5–6, 1992), Presented at the International Symposium on Giant Magnetostrictive Materials and Their Applications, Tokyo, Japan.

* cited by examiner

ULTRASONIC DOWNHOLE RADIATOR AND METHOD FOR USING SAME

This invention pertains generally to downhole apparatus for enhancing the flow of fluid in a hydrocarbon producing well and, more particularly, to downhole apparatus for generating ultrasonic energy to assist secondary recovery of fluid in a hydrocarbon producing well.

Downhole tools have been provided for supplying ultrasonic energy to oil in a bore hole to facilitate the extraction of the oil from the well. Such exposure of the oil to ultrasonic energy has been found to create a reduction in the viscosity of the oil. See for example U.S. Pat. Nos. 5,109,922 and 5,344,532. Unfortunately, such tools suffer from a number of disadvantages. The application of high intensity ultrasound has been limited due to the low energy density of the drive materials. The uniform application of the ultrasound to all of the bore hole fluid has also proven difficult. Any reduction in the viscosity of the bore hole fluid due solely to the ultrasound generated by such tools is typically temporary. Some of such tools have not proven to be reliable and resistant to wear in a downhole temperature environment. There is, therefore, a need for a new and improved downhole tool which overcomes these disadvantages.

In general, it is an object of the present invention to provide an ultrasonic downhole radiator and method for reducing the viscosity of a hydrocarbon-containing fluid such as oil in a bore hole so as to improve production.

Another object of the invention is to provide an ultrasonic downhole radiator and method of the above character which utilizes a magnetostrictive transducer.

Another object of the invention is to provide an ultrasonic downhole radiator and method of the above character in which a surfactant solution is supplied to the bore hole for facilitating the reduction in oil viscosity.

Another object of the invention is to provide an ultrasonic downhole radiator and method of the above character in which a base solution is supplied to the bore hole for facilitating the reduction in oil viscosity.

Another object of the invention is to provide an ultrasonic downhole radiator and method of the above character in which a base solution is created from the produced water down hole by electrolysis for facilitating the reduction in oil viscosity.

Additional objects and features of the invention will appear from the following description from which the preferred embodiments are set forth in detail in conjunction with the accompanying drawings.

In general, an apparatus for use down a bore hole to reduce the viscosity of a hydrocarbon-containing fluid in the bore hole is provided. The apparatus includes a housing having a size for disposition in the bore hole. At least one ultrasonic transducer is carried by the housing. The ultrasonic transducer preferably has an active element changeable from a first shape to a second shape in the presence of an electromagnetic field and means for producing an electromagnetic field which extends through at least a portion of the active element to change the shape of the active element. An acoustic element is coupled to the active element for providing ultrasonic energy to the hydrocarbon-containing fluid in the bore hole. A method for reducing the viscosity of a hydrocarbon-containing fluid in a bore hole is additionally provided.

Figures 1, 5:
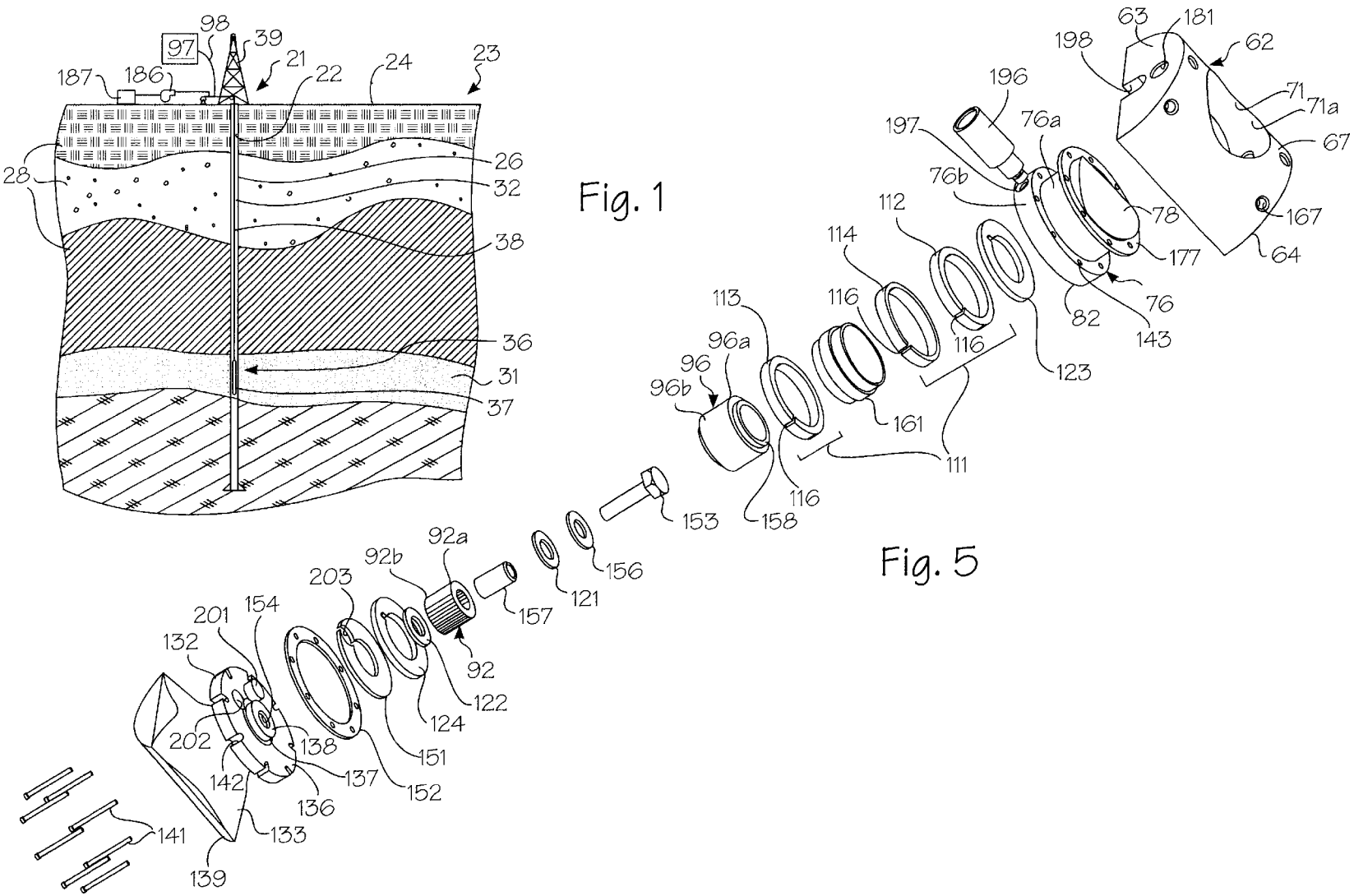
FIG. 1 is a schematic view of an ultrasonic downhole radiator of the present invention in operation in a borehole.
FIG. 5 is an exploded view of a magnetostrictive transducer of the ultrasonic downhole radiator of FIG. 1.

More in particular, the ultrasonic downhole radiator of the present invention is for use in a hydrocarbon-producing well 21 as shown in FIG. 1. Well 21 includes a bore hole 22 which extends into the earth 23 from ground surface 24. Bore hole 22 is formed by a wellbore 26 which extends through a plurality of earthen layers 28 which include a hydrocarbon-containing formation or oil producing zone 31. The bore hole 22 has a fluid therein which is a hydrocarbon-containing fluid such as oil 32. A work string 36 extends down bore hole 22 and includes at least one ultrasonic downhole apparatus or radiator 37 supported by a cable-like member in the form of coil tubing 38. The ultrasonic downhole radiator 37 is disposed in the portion of the bore hole 22 adjacent oil producing zone 31. The coil tubing 38 extends down hole from an above-ground support structure 39 at ground surface 24.

Ultrasonic downhole radiator 37 is substantially cylindrical in conformation and has a cross-sectional shape and diameter which are smaller than the cross-sectional shape and diameter of bore hole 22. The radiator 37 is formed from an elongate cylindrical housing 43 having upper and lower extremities 43*a* and 43*b* and extending along a central longitudinal axis 44 (see FIG. 2). A connector 46 is A provided at upper extremity 43*a* for securing the cylindrical housing 43 to coil tubing 38. A plurality of three circumferentially spaced-apart fins or spacers 47 are provided at various locations along the length of housing 43 for stabilizing and centering the radiator 37 within bore hole 22. As can be seen most clearly from FIG. 3, spacers 47 are circumferentially spaced-apart at separation angles of approximately 120°. Each of the spacers extends radially outwardly from the outer cylindrical wall 48 of housing 43.

Figures 2, 3:
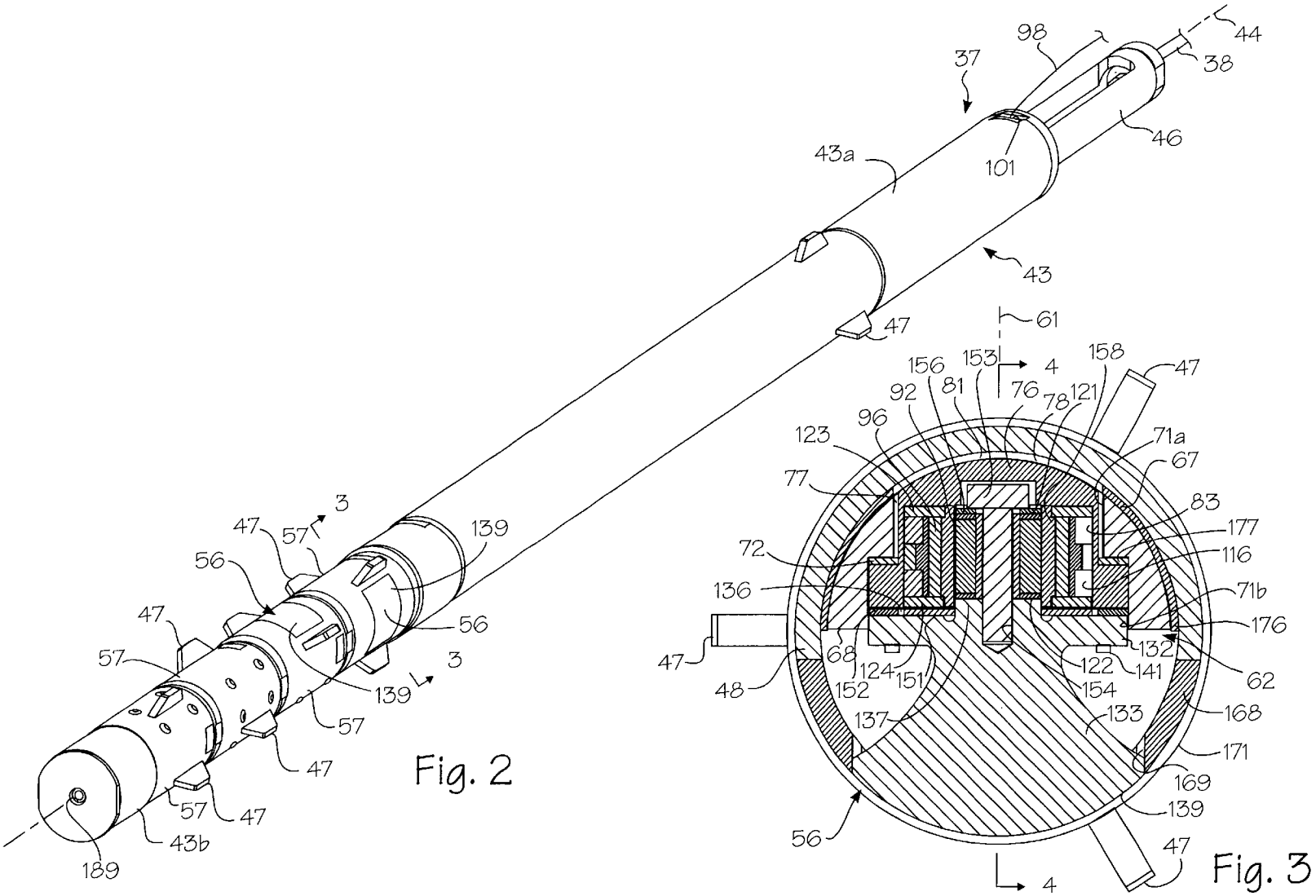
FIG. 2 is an isometric view of the ultrasonic downhole radiator of FIG. 1.
FIG. 3 is a cross-sectional view of the ultrasonic downhole radiator of FIG. 1 taken along the line 3—3 of FIG. 2.
Figure 4:
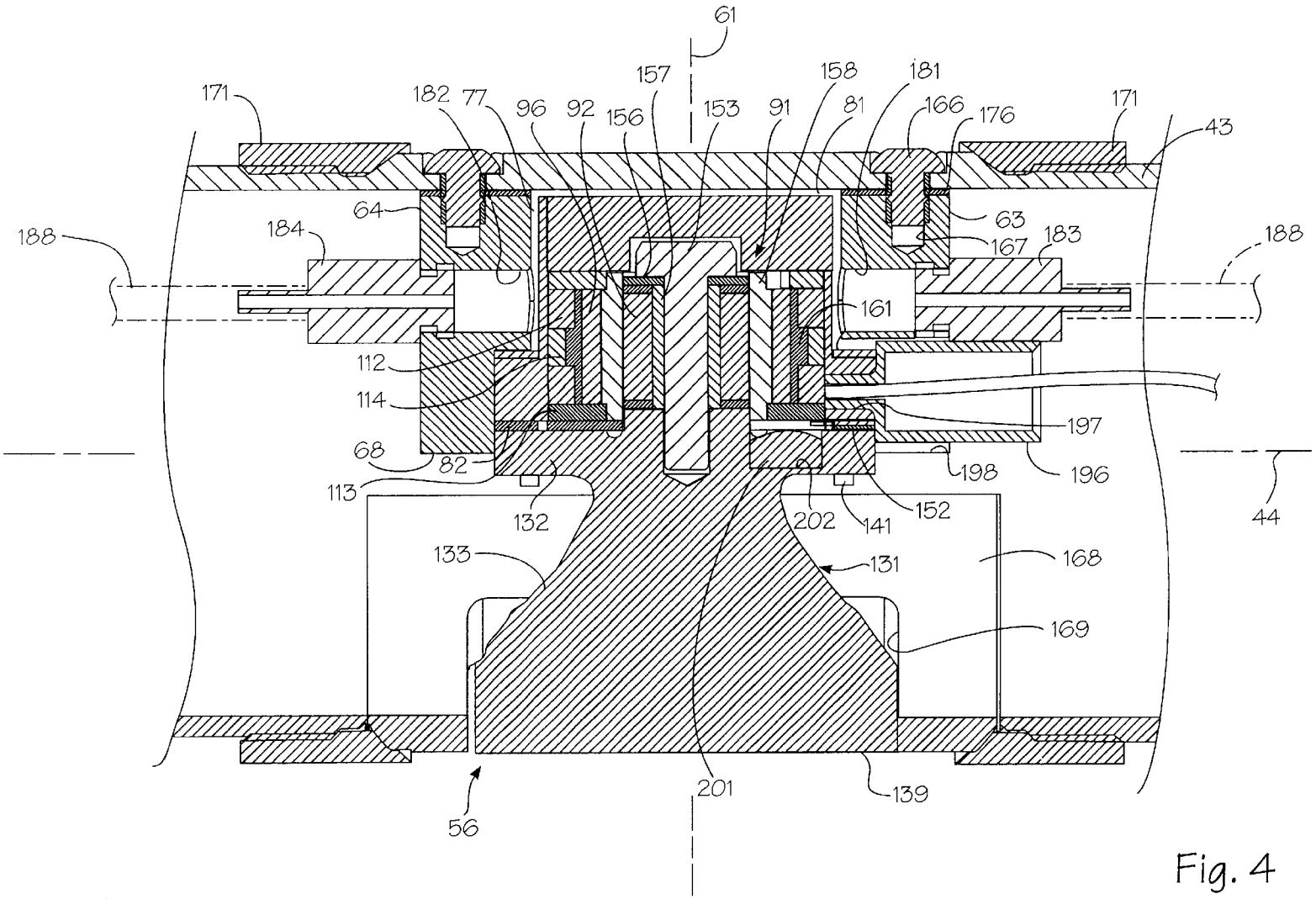
FIG. 4 is a cross-sectional view of the ultrasonic downhole radiator of FIG. 1 taken along the line 4—4 of FIG. 3.

At least one ultrasonic transducer 56 is carried by cylindrical a housing 43 for supplying ultrasonic energy to the fluid within bore hole 22. More specifically, a plurality of ultrasonic transducers are carried by the cylindrical housing 43. In an exemplary embodiment of the downhole radiator 37, a plurality of four ultrasonic transducers 56 are carried by lower extremity 43*b* in longitudinally spaced-apart positions on the cylindrical housing 43. In this regard, lower extremity 43*b* includes four segments 57, each of which carries an ultrasonic transducer 56. A cross-section perpendicular to longitudinal axis 44 of the upper most segment 57 is shown in FIG. 3 and a cross-section of such segment 57 along longitudinal axis 44 is shown in FIG. 4.

Each of the ultrasonic transducers 56 extends perpendicularly of central longitudinal axis 44 and has a central axis 61 which intersects central longitudinal axis 44 at a right angle. Each of the ultrasonic transducers 56 is formed with a housing member or housing 62 made from any suitable material such as plastic. The housing 62 has the shape approximating a half cylinder and includes first and second spaced-apart planar end surfaces 63 and 64 and a half-cylindrical surface 67 extending between the end surfaces 63 and 64. A planar side surface 68 extends along central longitudinal axis 44 perpendicularly of the end surfaces 63 and 64. Housing 62 is provided with a central bore 71 extending perpendicularly through side surface 68 and through half cylindrical surface 67. Bore 71 is circular in cross-section and steps down in diameter between side surface 68 and half cylindrical surface 67 at an annular surface 72. The bore 71 is divided by annular surface 72 between anti outer portion 71*a* of reduced diameter and an inner portion 71*b* of a larger diameter.

A protective shell 76 made from any suitable material which is preferably an electrical insulator and thermally conductive, such as aluminum nitride or silicon carbide, is disposed within bore 71. The protective shell 76 has an outer cylindrical portion 76*a* disposed in outer bore portion 71*a* and an inner flange portion 76*b* which seats in inner bore portion 71*b*. The outer diameter of cylindrical portions 76*a* is smaller than the inner diameter of outer bore portion 71*a* such that an annular space 77 is provided between the cylindrical portion 76*a* and the housing 62. The cylindrical portion 76*a* has an outer arcuate surface 78 which generally conforms to the inner surface of cylindrical housing 43 but is spaced-apart from such inner surface to provide an arcuate space 81. Flange portion 76*b* has a planar end surface 82 which extends perpendicularly of central axis 61. An annular recess 83 opening at end surface 82 extends through flange portion 76*b* and a portion of cylindrical portion 76*a* of the protective shell 76.

A motor assembly or motor 91 is disposed within annular recess 83 and is included within the ultrasonic transducer 56. rotor 91 has a cylindrical or tubular member in the form of a drive member 92 made from a suitable active or smart material which changes shape when energized by being placed in an electromagnetic field. The drive member 92 has first and second end portions 92*a* and 92*b*. Suitable smart materials for the drive member 92 include electrostrictive materials, piezoelectric materials or magnetostrictive materials. A preferred electrostrictive material for drive member 92 is lead magnesium niobate and its variants and a preferred piezoelectric material is lead zirconate titanate and its variants.

A magnetostrictive material, which changes shape in response to an applied magnetic field, is a particularly preferred material for drive member 92. In the illustrated embodiment, motor 91 is a magnetostrictive motor having a drive member or tube 92 changeable in length along longitudinal axis 258 between a first or shortened shape when in the absence of a magnetic field or in a low magnetic field and a second or elongated shape when in the presence of a magnetic field or a higher magnetic field. In one preferred embodiment of magnetostrictive motor 91, the drive tube 92 is a laminate. A giant magnetostrictive material is preferred because such a material can tolerate high mechanical stress for magnetic moment alignment so as to permit the drive tube 92 to have a relatively high transduction capability. High transduction capability, along with high energy density, enable more mechanical power output from a given electrical power input and volume of smart material and thus reduce the size and weight of motor 91. Such giant magnetostrictive materials also have the ability maintain performance at high temperatures and have inherent high reliability. Preferred giant magnetostrictive materials are rare earth materials, rare earth-transition metal materials and compositions having rare earth materials, transition metals and other elements.

Preferred rare earth materials for operating temperatures ranging from 0° to 200° K are rare earth binary alloys such as $Tb_xDy_{1-x}$, where x ranges from 0 to 1. Other rare earth elements can be added or substituted for either terbium or dysprosium in this base alloy. For example, holmium, erbium, gadolinium, lanthanum, cerium, praseodymium, neodymium, samarium or yttrium can be used in place of either terbium or dysprosium. Other preferred rare earth materials for operating temperatures ranging from 0° to 200° K are body centered cubic intermetallic compounds such as $(Tb_xDy_{1-x})(Zn_yCd_{1-y})$, where x ranges from 0 to 1, y ranges from 0 to 1 and x+y=1. Other rare earth elements, such as holmium, erbium, gadolinium, lanthanum, cerium, praseodymium, neodymium, samarium or yttrium, can be added or substituted for either terbium or dysprosium in these body centered cubic intermetallic compounds.

Preferred rare earth-transition metal materials suited for operating in temperatures ranging from 0° to 700° K have the formula $(R_{x1}R_{x2} \ldots R_{x11})_1(M_{y1}M_{y2} \ldots M_{y6})_z$ where each R is a rare earth element, preferably either lanthanum (La), cerium (Ce), praseodymium (Pr), neodymium (Nd), samarium (Sm), gadolinium (Gd), terbium (Tb), dysprosium (Dy), holmium (Ho), erbium (Er) or yttrium (Y). Any combination of these elements can be provided in said formula, as will be understood by the examples set forth below. In said formula, $0 \leqq x1 \leqq 1$, $0 \leqq x2 \leqq 1 \ldots 0 \leqq x11 \leqq 1$, that is, $0 \leqq x1 \leqq 1$, $0 \leqq x2 \leqq 1$, $0 \leqq x3 \leqq 1$, $0 \leqq x4 \leqq 1$, $0 \leqq x5 \leqq 1$, $0 \leqq x6 \leqq 1$, $0 \leqq x7 \leqq 1$, $0 \leqq x8 \leqq 1$, $0 \leqq x9 \leqq 1$, $0 \leqq x10 \leqq 1$ and $0 \leqq x11 \leqq 1$. In addition, $x1+x2+ \ldots +x11=1$, that is, $x1+x2+x3+x4+x5+x6+x7+x8+x9+x10+x11=1$. The composition of the rare earth atoms provides for the anisotropy of magnetostriction, the property which yields the giant magnetostrictive response of the alloy. Each M in said formula is a transition metal or metalloid and preferably one of the following elements: iron (Fe), manganese (Mn), cobalt (Co), nickel (Ni), aluminum (Al) or silicon (Si). As will be understood by the examples set forth below, any combination of these elements can be provided in said formula. In the formula, $0 \leqq y1 \leqq 1$, $0 \leqq y2 \leqq 1 \ldots 0 \leqq y6 \leqq 1$, that is, $0 \leqq y1 \leqq 1$, $0 \leqq y2 \leqq 1$, $0 \leqq y3 \leqq 1$, $0 \leqq y4 \leqq 1$, $0 \leqq y5 \leqq 1$ and $0 \leqq y6 \leqq 1$. In addition, $y1+y2+ \ldots +y6=1$, that is, $y1+y2+y3+y4+y5+y6=1$, and $1.8 \leqq z \leqq 2.1$. The composition of the transition metals and/or metalloids in the final alloy affects the magnetic properties of the alloy allowing for optimization of the alloy to a wide variety of uses. Exemplary rare earth-transition metal materials for operating in the 0° to 700° K. temperature range are disclosed in U.S. Pat. Nos. 4,308,474; 4,609,402; 4,770,704; 4,849,034; 4,818,304 and 5,110,376, the entire contents of which are incorporated herein by this reference.

Particularly preferred rare earth-transition metal materials are rare earth-iron materials and include the material known as TERFENOL-D sold by ETREMA Products, Inc. of Ames, Iowa. TERFENOL-D is a metal alloy formed from the elements terbium, dysprosium and iron and has the formula of $(Tb_xDy_{1-x})_1Fe_{1.8-2.1}$, where $0 \leqq x \leqq 1$. A preferred formula for TERFENOL-D is $Tb_xDy_{1-x}Fe_{1.90-1.95}$, where x ranges from 0.25 to 1.0 A particularly preferred formula for the TERFENOL-D material of drive tube 92 is $Tb_{0.3}Dy_{0.7}Fe_{1.92}$. Other suitable rare earth-iron materials included in said formula are:

$(Tb_{x1}Dy_{1-x1})_1(Mn_{y1}Fe_{1-y1})_{1.8-2.1}$, where $0 \leqq x1 \leqq 1$ and $0 \leqq y1 \leqq 0.5$;

$(Tb_{x1}Dy_{1-x1})_1(Co_{y1}Fe_{1-y1})_{1.8-2.1}$, where $0 \leqq x1 \leqq 1$ and $0 \leqq y1 \leqq 1$;

$(Tb_{x1}Dy_{1-x1})_1(Ni_{y1}Fe_{1-y1})_{1.8-2.1}$, where $0 \leqq x1 \leqq 1$ and $0 \leqq y1 \leqq 1$;

$(Tb_{x1}Dy_{1-x1})_1(Al_{y1}Fe_{1-y1})_{1.8-2.1}$, where $0 \leqq x1 \leqq 1$ and $0 \leqq y1 \leqq 0.1$;

$(Tb_{x1}Dy_{1-x1})_1(Al_{y1}Mm_{y2}Fe_{1-y1-y2})_{1.8-2.1}$, where $0 \leqq x1 \leqq 1$, $0 \leqq y1 \leqq 0.1$ and $0 \leqq y2 \leqq 0.5$;

$(Tb_{x1}Dy_{1-x1-x2}HO_{x2})_1(Al_{y1}Fe_{1-y1})_{1.8-2.1}$, where $0 \leqq x1 \leqq 1$, $0 \leqq x2 \leqq 0.5$, $x1+x2 \leqq 1$ and $0 \leqq y1 \leqq 0.1$;

$(Tb_{x1}Dy_{1-x1})_1(Co_{y1}Mn_{y2}Fe_{1-y1-y2})_{1.8-2.1}$, where $0 \leqq x1 \leqq 1$, $0 \leqq y1 \leqq 1$, $0 \leqq y2 \leqq 0.5$ and $y1+y2 \leqq 1$; and $(Tb_{x1}Dy_{1-x1-x2}Ho_{x2})_1(CO_{y1}Mn_{y2}Fe_{1-y1-y2})_{1.8-2.1}$, where $0 \leqq x1 \leqq 1$, $0 \leqq x2 \leqq 0.5$, $x1+x2 \leqq 1$, $0 \leqq y1 \leqq 1$, $0 \leqq y2 \leqq 0.5$ and $y1+y2 \leqq 1$.

Rare earth-transition metal materials which contract and thus exhibit negative magnetostriction when placed in a magnetic field are also included in said formula and preferably include the rare earth element samarium. A particularly preferred negative magnetostrictive material is SAMFENOL-D, which has the formula $(Sm_{x1}Dy_{1-x1})_1Fe_{1.8-2.1}$, where $0 \leqq x1 \leqq 1$. Other suitable negative magnetostrictive materials are:

$(Sm_{x1}Ho_{1-x1})_1Fe_{1.8-2.1}$, where $0 \leqq x1 \leqq 1$; and $(Sm_{x1}Ho_{1-x1})_1Co_{y1}Fe_{1-y1})_{1.8-2.1}$, where $0 \leqq x1 \leqq 1$ and $0 \leqq y1 \leqq 1$.

Dynamic electromagnetic field generation means is provided in magnetostrictive motor 91 for producing an electromagnetic field which extends through at least a portion of the active or smart material of the motor 91. In those embodiments where the drive member 92 is an active or smart material such as an electrostrictive or piezoelectric material, the dynamic electromagnetic field generation means are known to those skilled in the art. Where drive member or tube 92 is a magnetostrictive material, such means is in the form of a dynamic magnetic field generation means which produces a magnetic field extending through at least a portion of drive tube 92 to change the shape of the drive tube 92 (see FIGS. 3 and 4). In this regard, an elongate tubular means or coil 96 is concentrically disposed about drive tube 92 and is included within the means of motor 91 for producing a magnetic field through the entire drive tube 92. Excitation or drive coil 96 has first and second end portions 96*a* and 96*b* and is annular in cross section. The drive coil 96 has a length approximating the length of drive tube 92 and is made from any suitable conductive material such as fine magnet wire of copper, aluminum, niobium titanium or silver for producing a magnetic field having a flux which extends through the drive tube 92.

Means for providing an electrical signal to excitation coil or wire solenoid 96 includes a controller and power supply 97 located at the well head and electrically coupled to the coil 96 by means of lead means or wires 98 extending down the bore hole 22 to cylindrical housing 43 (see FIGS. 1 and 4). An opening 101 is provided in upper extremity 43*a* of the housing 43 for permitting wires 98 to enter the interior of the housing 43 (see FIG. 2).

Magnetic means or tubular bias magnetic means 111 is provided in motor 91, as shown in FIGS. 3–5, for continuously biasing drive tube 92. Bias magnetic means 111 is formed from a plurality of tubular magnets concentrically disposed around drive coil 96 and aligned in juxtaposition with each other along the length of the drive coil. First and second annular end magnets 112 and 113 form the first and second opposite end portions of bias magnetic means 111. An annular intermediate magnet 114 is disposed between end magnets 112 and 113. The individual magnets 112–114 of bias magnetic means 111 are each made from a hard magnetic material of any suitable type such as many of the different grades of neodymium iron boron. Alternatively, these magnets can be made from materials such as samarium cobalt, ferrite ceramic or aluminum nickel cobalt.

The individual magnets 112–114 of bias magnetic means 111 are sized and shaped to produce a uniform DC magnetic field through the drive tube 92. The outer diameters of such individual magnets are approximately equal. In addition, the inner diameters of end magnets 112 and 113 are approximately equal. The inner diameter of intermediate magnet 114 is larger than the inner diameters of end magnets 112 and 113. As such, the individual magnets 112–114 step down in thickness toward the longitudinal center of bias magnetic means 111 so that the radial thicknesses of the bias magnets increase toward the opposite ends of drive coil 96 and drive tube 92. The individual magnets 112–114 of bias magnetic means 111 have an aggregate length closely approximating the length of drive tube 92. Each of the individual magnets 112–114 has respective planar end surfaces which extend parallel to each other and is provided with a slit 116 extending radially therethrough (see FIGS. 3 and 5). Slits 116 are longitudinally aligned to form a plane extending through central axis 61 and serve to preclude electrical currents from traveling circumferentially around bias magnetic means 111. Such currents can create unwanted magnetic fields and heat which degrade the desired performance of motor 91.

First and second flux return means are included within motor 91 for capturing the DC magnetic field created by bias magnetic means 111 and directing this DC field through drive tube 92. The first and second flux return means also capture the AC magnetic field generated by drive coil 96 and channel this AC field into drive tube 92. The first and second flux return means include first and second inner annular rings 121 and 122 concentrically centered on central axis 61 and disposed on the opposite end surfaces of first and second end portions 92*a* and 92*b* of the drive tube 92. The first rings 121 and 122 each have outer and inner diameters approximately equal to the outer and inner diameters of the drive tube 92. The first and second flux return means further include first and second outer annular rings 123 and 124 concentrically disposed about respective first and second inner rings 121 and 122 and centered on central axis 61. The first and second outer rings 123 and 124 are disposed on the opposite end surfaces of respective first and second end portions 96*a* and 96*b* of the drive coil 96 and the opposite end surfaces of respective first and second annular end magnets 112 and 113. The second rings 123 and 124 each have an outer diameter equal to the outer diameter of bias magnetic means 111 and an inner diameter equal to the inner diameter of drive coil 96.

The flux return rings 121–124 are each made from any suitable ferromagnetic or soft magnetic material having a relatively low electrical conductivity and a relatively high electrical resistivity. The flux return rings 121–124 also have a relatively high magnetic saturation flux density. It is preferred that the material of rings 121–124 has an electrical resistivity greater than 1000 ohm-cm, although a more practical electrical resistivity range is between 0.01 to 1000 ohm-cm. It is preferable that the magnetic saturation flux density be greater than 8,000 gauss, more preferably greater than 12,000 gauss and most preferably greater than 20,000 gauss. A suitable material for rings 121–124 is the material marketed under the trade name High Flux by Arnold Engineering of Marengo, Ill. and by Magnetics of Butler, Pa. High Flux is a nickel and iron alloy having the composition of 0.5 nickel and the balance iron. The nickel and iron elements of the High Flux material are ground into micron and sub-micron particle sizes. A dielectric is sprayed on the particles to electrically insulate them and that powder mix is compressed at roughly 200 tons per square inch to make a solid component. Another suitable material is iron powder marketed by MMG-North America of Paterson, N.J. The iron powder has a composition of greater than 95% iron. The iron powder is produced in a manner similar to the method described above for producing High Flux. Briefly, the iron elements are ground into micron and sub-micron particle sizes. A dielectric is sprayed on the particles to electrically insulate them and that powder mix is compressed to make a solid component which is the equivalent of a sandstone structure. Each of these materials has an electrical resistivity ranging from 0.01 to 50 ohm-cm and a magnetic saturation flux density ranging from 12,000 to 15,000 gauss. High Flux has a high relative permeability which makes it a good magnetic flux conductor.

An acoustic element 131 is included within magnetostrictive motor 91 and coupled to drive tube 92 for providing ultrasonic energy to oil 32 within bore hole 22. The acoustic element 131 is centered on central axis 61 and includes a flange portion or flange 132 and a horn 133. Flange 132 has a planar surface 136 extending perpendicularly to central axis 61. A hub 137 extends upwardly from planar surface 136 and has an end surface 138 extending parallel to planar surface 136. Horn 133 resembles a sector of a cylinder and has an arcuate surface or face 139 having a radius equal to the outer radius of cylindrical housing 43. The arcuate face 139 subtends an angle of approximately 90° about longitudinal axis 44.

Acoustic element 131 is made from any suitable material such as a metal and preferably an acoustic metal. Suitable acoustic metals are aluminum alloys, magnesium alloys and titanium alloys. A magnesium alloy is preferred for the material of acoustic element 131. Preferred magnesium alloys for forming acoustic element 131 are high mechanical Q/low damping materials with high fatigue strength. Most preferable materials also have a relatively high electrical resistivity.

Acoustic element 131 has a longitudinal dimension or length measured along central axis 61 from end surface 138 to the middle of arcuate face 139 of approximately 2.5 inches, which is equal to the quarter resonant wavelength of the material of the acoustic extension. The acoustic element 131 is thus sized to vibrate at its resonant frequency when driven by magnetostrictive motor 91.

A plurality of fasteners or cap screws 141 are included within the means of securing acoustic element 131 to housing 62. Flange 132 of the acoustic element 131 at least partially seats within inner bore portion 71*b* and has an outer diameter approximating the diameter of inner bore portions 71*b*. A plurality of circumferentially disposed slots 142 are provided in flange 132 and extend perpendicularly through surface 136 for receiving cap screws 141. The screws 141 extend through a plurality of bores 143 provided in flange portion 76*b* of the protective shell 76. The threaded ends of the cap screws 141 are received within respective threaded bores (not shown) provided in housing 62 and opening at annular surface 72. An annular washer 151 made from aluminum nitride, silicon carbide or any other suitable electrically insulative and thermally conductive material sits on planar surface 136 about hub 137. An annular gasket 152 made from any suitable material such as engineered rubber is disposed between planar surface 136 of the acoustic element 131 and end surface 82 of the protective shell. The gasket 152 is spaced radially outwardly from annular washer 151. In the assembly of ultrasonic transducer 56, the first outer ring 123 sits on the end surface of annular recess 83 and the second outer ring 124 rests on the washer 151. Rings 123 and 124 and the components therebetween are thus sandwiched between protective shell 76 and acoustic element 131 under the force of cap screws 141.

Means is included within motor 91 for imparting a mechanical preload on drive tube 92 and includes a preload bolt 153 centered on axis 61. The preload bolt 153 extends through the center of drive tube 92 and has a threaded end which screws into a threaded bore: 154 provided in hub 137. Bore 154 opens at end surface 138. The preload bolt 153 has an enlarged head which sits on an annular washer 156 resting atop first inner ring 121. Tightening of the preload bolt 153 imparts a compressive preload on the drive tube 92 which ranges from 400 to 800 pounds and is preferably approximately 630 pounds.

Heat transfer means which includes a plurality of heat transfer elements is provided in magnetostrictive motor 91 for transferring heat away from drive tube 92 and drive coil 96 during the operation of ultrasonic transducer 56. In this regard, a tubular member or bolt tube 157 is concentrically disposed about preload bolt 153 inside drive tube 92. Bolt tube 157 is made from any suitable material such as aluminum nitride or titanium and serves to transfer heat from the drive tube 92 to the preload bolt 153. Such heat is then transferred by the preload bolt 153 to acoustic element 131 for dissipation at arcuate face 139.

The heat transfer means of motor 91 further includes a heat transfer tube 158 concentrically disposed about drive tube 92 between the drive tube and the drive coil 96 and a heat transfer element 161 concentrically disposed about drive coil 96 between the drive coil and the bias magnetic means 111. Tube 158 and element 161 are each made from any suitable material such as aluminum nitride. The heat transfer element has an outer surface having the shape of the inner surface of the bias magnetic means 111 so as to engage the bias magnetic means 111 along the entire length thereof for facilitating the transfer of heat therefrom. The first end of heat transfer tube 158 engages the inner surface of protective shell 76 forming the end of annular recess 83 and thus transfers heat from the drive tube 92 and the drive coil 96 to the protective shell. The second end of the heat transfer tube 158 engages washer 151, also included in the heat transfer means of motor 91, and thus serves to transfer heat to acoustic element 131. Heat transfer element 161 is disposed between first and second outer rings 123 and 124. Heat from the drive coil 96 is thus transferred from the first end of the heat transfer element 161 through first outer ring 123 to protective shell 76 and from the second end of the heat transfer element through second outer ring 124 to the acoustic element 131.

Fastening means is included in radiator 37 for securing each of the ultrasonic transducers 56 to the respective segment 57 of cylindrical housing 43. The fastening means includes a plurality of fasteners or screws 166 which extend through cylindrical wall 48 and have respective threaded ends which engage respective threaded bores 167 provided in housing 62 (see FIG. 4). Bores 167 open on half-cylindrical surface 67 of the housing 62. The cylindrical housing 43 includes a removable door 168 for permitting placement of each ultrasonic transducer 56 in the housing 43 (see FIGS. 2 and 4). Each of the doors 168 has a shape approximating that of a half-tubular cylinder and has a central opening 169 therein through which the acoustic element 131 of the transducer 56 extends. As can be seen from FIGS. 3 and 4, outer arcuate face 139 of the acoustic element 131 forms a portion of the relatively smooth outer cylindrical surface of housing 43. Door 168 is secured to the cylindrical wall 48 of housing 43 by first and second annular lock rings 171 which each threadedly mount about the outside of cylindrical housing 43. A lock ring 171 engages each end of the removable door 168.

Active cooling means is included in ultrasonic transducer 56 for removing heat from motor 91 during operation of radiator 37. In this regard, annular space 77 and arcuate space 81 form part of a fluid passageway extending through the transducer 56 for carrying heat away from protective shell 76. A plurality of seals are provided in the transducer 56 for making spaces 77 and 81 fluid tight. As can be seen from FIGS. 3 and 4, a sealing member or seal 176 is disposed between half-cylindrical surface 67 of the transducer 56 and the inner surface of cylindrical housing 43 for creating a fluid tight seal between the housings 43 and 62. An annular seal 177 is disposed between annular surface 72 and flange portion 76*b* of the protective shell 76 for providing a fluid-tight seal between housing 62 and protective shell 76. Housing 62 is provided with first and second orifices 181 and 182 in respective first and second end surfaces 63 and 64 which communicate with bore 71 and thus annular space 77 (see FIGS. 4 and 5). First and second connectors 183 and 184 are secured to housing 62 at respective orifices 181 and 182 (see FIG. 4).

The active cooling means of radiator 37 includes a fluid pump 186 at the well head which pumps any suitable coolant such as water from a reservoir 187 through coil tubing 38 down the bore hole 22 (see FIG. 1). A coolant tube 188, a portion of which is shown in FIG. 4, is coupled within radiator 37 to the end of coil tubing 38 for supplying the coolant or cooling liquid to first or inlet connector 183 and thus annular space 77 and arcuate space 81. The coolant carries heat from protective shell 76 and is removed from the ultrasonic transducer 56 by second or outlet connector 184. The inlet and outlet connectors 183 and 184 of the four ultrasonic transducers 56 of radiator 37 are connected in series by coolant tube 188. The cooling liquid is carried by tube 188 to a discharge opening 189 provided in the lower end of cylindrical housing 43 (see FIG. 2).

Electrical wires 98 are coupled to each ultrasonic transducer 56 by means of an adapter 196 (see FIGS. 4 and 5). The adapter 196 has a threaded end which mates with a threaded bore 197 provided in flange portion 76*b* of the protective shell 76. A slot 198 is formed in housing 62 and extends through housing end surface 63 for permiting access by the adapter 196 to threaded bore 197. Wires 98 extend through the adapter 196 and bore 197 into annular recess 83 for connection to drive coil 96. A conventional temperature sensitive switch 201 is provided for monitoring the temperature of magnetostrictive motor 91 and preventing thermal failure of the motor 91. Switch 201 sits within a recess 202 provided in flange 132 of the acoustic element 131. The recess 202 opens through flange surface 136. A hole 203 is provided in washer 151 for facilitating the monitoring of the temperature of heat transfer tube 158 and second outer ring 124 accessible through washer hole 203.

The centerlines of the arcuate faces 139 of the plurality of ultrasonic transducers 56 are circumferentially disposed around the outer cylindrical wall 48 of housing 43 at approximately equal separation angles. In the exemplary embodiment shown, the centerlines of the four arcuate faces 139 are circumferentially disposed around the outer cylindrical wall 48 at 90° separation angles. Thus, the four ultrasonic transducers 56 radiate ultrasonic energy radially outwardly from housing 43 throughout the 360° circumference of the housing 43.

In operation and use, ultrasonic radiator 37 can be lowered into a petroleum producing well to impart ultrasonic energy to oil 32 in the bore hole 22. The ultrasonic energy reduces the viscosity of the oil so as to allow the oil to be pumped more easily to the surface of the well 21. Alternatively, the ultrasound or ultrasonic: energy generated by radiator 37 can be used in conjunction with a suitable fluid to create an emulsion, as more fully set forth below. An existing down hole pump is then used to lift the oil to the surface. The reduction in viscosity of the oil 32 results in a reduction in the energy required to lift the oil to the ground surface 24.

The ultrasonic transducers 56 in radiator 37 are driven by an electrical signal provided by power supply and controller 97 located at the well head. Such electrical power from controller 97 may be at the final operating frequency or may be converted down hole to the desired operating frequency. Power supply 97 provides power in the range from 100 to 10,000 watts and preferably in excess of 1000 watts. The power supply 97 most preferably provides as approximately 8000 watts of power to motors 91 at approximately 1200 volts and 6.7 amps. The supplied power can be in the form of an ultrasonic three phase sinusoidal signal or in the form of direct current which is converted downhole to such a sinusoidal signal.

Ultrasonic energy is imparted to the well bore fluid by oscillating the acoustic element 131 of each ultrasonic transducer 56 at an ultrasonic frequency, that is in excess of 17 kHz. Each of the acoustic elements 131 is driven by a magnetostrictive motor 91. The drive tube 92 in each motor longitudinally expands and contracts in response to the alternating magnetic field generated by the respective drive coil 96. Such movement of the drive tube 92 against the compressive force of the preload bolt 153 results in ultrasonic vibration of the acoustic element 131 coupled to the motor 91. The motors 91 are each designed to be resonant at the frequency of operation in order to take advantage of stroke amplification. More specifically, the motors 91 each operate as a half-wavelength motor. Since each ultrasonic transducer 56 of radiator 37 operates independently, there is no need to mechanically operate the transducers in phase.

The arcuate faces 139 of the acoustic elements 131 each create a propagating curved wave front which remains in phase and conformal to the radiating surface 139 to transmit energy to the fluid in the bore hole 22. The propagating wavefront has a frequency equal to the drive signal to drive coil 96. The transducers 56 preferably operate at a low ultrasonic frequency with a displacement resulting in an energy intensity at the horn 133 ranging from 0.5 to 15 $W/cm^2$, preferably from 5 to 10 $W/cm^2$ and more preferably approximately 10 $W/cm^2$. The hydrocarbon-containing fluid is exposed to the ultrasonic energy as it flows up the bore hole 22 past the arcuate face 139 of a transducer.

The ultrasonic vibration from ultrasonic downhole radiator 37 can be used to heat the oil 32 in the formation around the wellbore 26 upstream from the vibrating face 139 of a transducer 56. Such heating is caused by rapid compression of the micro gas bubbles or cavitation in the oil 32 and serves to reduce the viscosity of the oil. In this manner, the viscous skin effect due to the natural degassing of the heavy oil around the wellbore 26 is reduced.

The ultrasonic vibration from radiator 37 can also be used to improve convective heating of the oil 32 by creating vortex or turbulent flow in the bore hole 22 and reducing oil viscosity. Thus, in other applications which are not illustrated, an electrical resistance heater can be used to raise the temperature of the oil in a conductor pipe from the sea floor to the water surface or across permafrost with minimal wax deposition.

Fluids can optionally be supplied to the bore hole 22 in the vicinity of the ultrasonic radiator 37 for enhancing the reduction in the viscosity of the oil 32 in the bore hole. Although such fluids can be supplied by a dedicated fluid line extending down the bore hole 22 or by any other suitable means, in one preferred embodiment of the invention, such fluids also serve as the cooling fluid for ultrasonic transducers 56. In one such preferred embodiment, a surfactant solution is provided in reservoir or tank 187 and supplied to the bore hole 22 by coil tubing 38.

Any suitable anionic, cationic or nonionic surfactant solution can be used to create a water external phase emulsion. The surfactant solution is introduced into the fluid of the bore hole by means of discharge opening 189. Thereafter, the surfactant solution mixes with the oil or other hydrocarbon-containing fluid in the bore hole 22 to form a mixture. As such mixture flows by an arcuate face 139 of an ultrasonic transducer 56, the ultrasonic energy from the ultrasonic transducer converts the mixture into a stable water external phase emulsion of relatively low viscosity for facilitating removal of the hydrocarbon-containing fluid from the bore hole 22. In one preferred embodiment, ultrasonic vibration with power levels near soft cavitation are provided. The emulsion can have a viscosity that ranges from 2 to 200 centipoise for oil contents ranging from 10% to 90%. The emulsion can be cooled down below the cloud point of the oil with only a 5% to 10% increase in the viscosity of the emulsion.

The reduced fluid viscosity decreases friction pressure drop in the bore hole 22, decreases fluid friction in the pump utilized for pumping oil from the well 21 and decreases fluid drag on the sucker rods of such pump. The lower friction pressure drop decreases the bottom hole pressure and improves productivity of the well. The decreased fluid friction in the pump and reduced fluid drag on the sucker rods improves the surface pumping unit efficiency.

In another method of the invention, a base solution is provided in reservoir 187 and supplied to the bore hole 22 by coil tubing 38. Any suitable base solution can be used. Exemplary base solutions are recycled produced water with make up sodium hydroxide, sodium silica or other base salt to make the pH greater than 9. The base solution is introduced into the fluid of the bore hole by means of discharge opening 189. Thereafter, the base solution mixes with hydrocarbon acids in the oil to form a surfactant solution which then mixes with the oil or other hydrocarbon-containing fluid in the bore hole 22 to form a mixture. As such mixture flows by an arcuate face 139 of an ultrasonic transducer 56, the ultrasonic energy from the ultrasonic transducer converts the mixture into a stable water external phase emulsion of relatively low viscosity for facilitating removal of the hydrocarbon-containing fluid from the bore hole 22. Most heavy oils have a high enough acid number to create stable water external phase emulsions with a base solution. In one preferred embodiment, ultrasonic vibration with power levels above soft cavitation are provided.

In an alternate embodiment of such method, the base solution is injected in the bore hole 22 where a 50% water external phase emulsion can be created by a first ultrasonic transducer 56. A second ultrasonic transducer 56 can then be used to mix the additional produced oil in the bore hole with the 50% water external phase emulsion to create a 10% to 15% water external phase emulsion. Additional water can be used to make the emulsion if desalting the oil is necessary.

In a further alternate embodiment of such method, the base solution is created in the bore hole 22 upstream of radiator 37 from electrolysis of the produced water. As such mixture flows by an arcuate face 139 of an ultrasonic transducer 56, the ultrasonic energy from the ultrasonic transducer converts the mixture into a stable water external emulsion of relatively low viscosity for facilitating removal of the hydrocarbon-containing fluid from the bore hole 22. A graphite electrode must be used on the positive side to prevent oxygen production. This embodiment is particularly suited in remote environments.

Although the invention has been described with only one ultrasonic radiator 37 disposed in the bore hole 22, it should be appreciated that a plurality of radiators 37 can be provided along the work string 36 so as to ensure that sufficient energy is transmitted to the oil 32 along the flow path to reduce the viscosity of the oil. The number of ultrasonic transducers provided in the bore hole 22 is determined in part by the production rate of the well 21 and the time required for the ultrasonic energy to have the desired effect on the hydrocarbon in the well fluid. In addition, the vibrating or radiating surface may be other than the cylindrical shape of arcuate face 139. In another embodiment, for example, the vibrating surface may be in the form of a radiating disk.

The apparatus and methods of the invention can be used in other than vertical bore holes. For example, the apparatus and method can be used for transporting oil over horizontal distances such as along a sea floor. The methods of the invention can be used with ultrasonic energy producing tools other than ultrasonic radiator 37. The method of invention is broad enough to cover supplying ultrasonic energy to hydrocarbon-containing fluid in a fluid-containing passageway to reduce the viscosity of the hydrocarbon-containing fluid.

The ultrasonic downhole radiator described herein may also be used for purposes other than reducing the viscosity of the fluid in a bore hole. For example, the radiator may be used for down hole ultrasonic cleaning.

From the foregoing, it can be seen that an ultrasonic downhole radiator and method have been provided for reducing the viscosity of a hydrocarbon-containing fluid such as oil in a bore hole so as to improve production. The ultrasonic downhole radiator and method preferably utilizes a magnetostrictive transducer. In one embodiment, a surfactant solution is supplied to the bore hole for facilitating the reduction in oil viscosity. In another embodiment, a base solution is supplied to the bore hole for facilitating the reduction in oil viscosity. In a further embodiment, the base solution is created from the produced water down hole by electrolysis.

What is claimed is:

1. An apparatus for use down a bore hole to reduce the viscosity of a hydrocarbon-containing fluid in the bore hole comprising a housing having a size for disposition in the bore hole and at least one ultrasonic transducer carried by the housing, the ultrasonic transducer having an active element changeable from a first shape to a second shape in the presence of an electromagnetic field and means for producing an electromagnetic field which extends through at least a portion of the active element to change the shape of the active element and an acoustic clement coupled to the active element for providing ultrasonic energy to the hydrocarbon-containing fluid in the bore hole, the housing having an outer cylindrical wall formed in put by the acoustic element.

2. The apparatus of claim 1 wherein the active element is a cylindrical member and wherein the means for producing an electromagnetic field is a coil made from a conductive material concentrically disposed about the cylindrical member.

3. The apparatus of claim 2 further comprising magnetic means for biasing the active element.

4. The apparatus of claim 3 wherein the magnetic means includes tubular magnetic means concentrically disposed about the cylindrical member.

5. The apparatus of claim 2 wherein the cylindrical member has first and second opposite ends, first and second flux return elements carried by the housing adjacent the first and second ends of the cylindrical member for capaturing magnetic flux produced by the coil and directing said magnetic flux through the cylindrical member.

6. The apparatus of claim 1 wherein the acoustic element is made from a material, the acoustic element having a lenght equal to the quarter resonant wavelength of the material.

7. The apparatus of claim 1 wherein the acoustic element is made from an acoustic metal.

8. The apparatus of claim 7 wherein the acoustic element is made from a magnesium alloy.

9. The apparatus as in claim 1 wherein the acoustic element has an arcuate surface conforming to a portion of the outer cylindrical wall.

10. The apparatus of claim 1 wherein the active element is a magnetostrictive material.

11. The apparatus of claim 10 wherein the magnetostrictive material is a rare earth-transition metal material.

12. The apparatus of claim 11 wherein the rare earth-transition metal material has the formula $(Tb_xDy_{1-x})_1 Fe_{1.8-1.2}$, where $0 \leqq x \leqq 1$.

13. The apparatus of claim 1 wherein the housing extends along a longitudinal axis and the at least one ultrasonic transducer extend transversely of the longitudinal axis.

14. An apparatus for use down a bore hole to reduce the viscosity of a hydrocarbon-containing fluid in the bore hole comprising a housing having a size for disposition in the bore hole and a plurality of ultrasonic transducers carried by the housing, each of the ultrasonic transducers having an active element changeable from a first shape to a second shape in the presence of an electromagnetic field and means for producing an electronic field which extends through at least a portion of the active element to change the shape of the active element and an acoustic element coupled to the active element for providing ultrasonic energy to the hydrocarbon-containing fluid in the bore hole, the housing having an outer cylindrical wall and the plurality of acoustic elements being longitudinally spaced-apart along the housing and circumferentially disposed around the outer cylindrical wall at approximately equal separation angles.

15. The apparatus of claim 14 wherein the acoustic elements are circumferentially disposed around the outer cylindrical wall at 90° separation angles.

16. The apparatus of claim 14 wherein the active element in each of the ultrasonic transducers is a cylindrical member and wherein the respective means for producing an electromagnetic field is a coil made from a conductive material concentrically disposed about the cylindrical member.

17. The apparatus of claim 16 further composing magnetic means included in each of the ultrasonic transducers for biasing the respective active element.

18. The apparatus of claim 17 wherein the magnetic means includes tubular magnetic means concentrically disposed about thee cylindrical member.

19. The apparatus of claim 16 wherein the cylindrical member has first and second opposite ends, first and second flux return elements carried by the housing adjacent the first and second ends of the cylindrical member in each of the ultrasonic transducers for capturing magnetic flux produced by the coil and directing said magnetic flux through the cylindrical member.

20. The apparatus of claim 14 wherein the acoustic element in each of the ultrasonic transducers is made from a material, the acoustic element having a length equal to the quarter resonant wavelength of the material.

21. The apparatus of claim 14 wherein the acoustic element in each of the ultrasonic traducers is made from an acoustic metal.

22. The apparatus of claim 21 wherein the acoustic element is made from a magnesium alloy.

23. The apparatus of claim 14 wherein the active element in each of the ultrasonic transducer is a magnctogtrictivc material.

24. The apparatus of claim 23 wherein the magnetostrictive material is a rare earth-transition metal material.

25. The apparatus of claim 24 wherein the rare earth-transition metal material has the formula $(Tb_xDy_{1-x})_1 Fe_{1.8-2.1}$, where $0 \leqq x \leqq 1$.

26. The apparatus of claim 14 wherein the housing extends along a longitudinal axis and each of the ultrasonic transducers extends transversely of the longitudinal axis.

27. A method for facilitating removal of a hydrocarbon-containing fluid in a bore hole having produced water therein comprising the steps of forming a base solution from electrolysis of the produced water, combining the base solution with hydrocarbon acids in the hydrocarbon-containing fluid to form a surfactant solution, mixing the surfactant solution with the hydrocarbon-containing fluid to form a mixture and supplying ultrasonic energy to the mixture to create a stable water external phase emulsion of relatively low viscosity.

28. A method as in claim 27 wherein the supplying step includes the step of supplying the ultrasonic energy from a magnetostrictive transducer disposed in the bore hole to cavitate the mixture.

* * * * *